US006957999B1

(12) United States Patent
Motta et al.

(10) Patent No.: US 6,957,999 B1
(45) Date of Patent: Oct. 25, 2005

(54) VEHICLE WHEEL RIM POLISHER

(75) Inventors: John Steven Motta, Calgary (CA); Stephen Withington, Calgary (CA)

(73) Assignee: Vehicle Inspection Systems Inc., Calgary (CA)

( * ) Notice: Subject to any disclaimer, the term of this patent is extended or adjusted under 35 U.S.C. 154(b) by 0 days.

(21) Appl. No.: 10/906,216

(22) Filed: Feb. 9, 2005

(51) Int. Cl.[7] ..... B24D 17/00
(52) U.S. Cl. ..... 451/11; 451/28; 451/398
(58) Field of Search ..... 451/5, 11, 28, 51, 451/61, 66, 209, 210, 246, 285, 398, 402

(56) References Cited

U.S. PATENT DOCUMENTS

| | | | | |
|---|---|---|---|---|
| 2,787,089 | A | 4/1957 | Hawkinson | |
| 4,226,054 | A | 10/1980 | Coty | |
| 4,308,631 | A | 1/1982 | Hanna | |
| 4,550,464 | A | 11/1985 | Messing | |
| 4,825,596 | A | 5/1989 | Kinner | |
| 4,878,262 | A | 11/1989 | Stufflebeam et al. | |
| 4,916,771 | A | 4/1990 | Weigele | |
| 4,965,905 | A * | 10/1990 | Kitahata et al. | 15/97.1 |
| 5,131,110 | A | 7/1992 | Hadgis | |
| 5,175,900 | A | 1/1993 | Hadgis | |
| 5,247,767 | A | 9/1993 | Hadgis | |
| 5,851,142 | A | 12/1998 | Bullock | |
| 5,890,952 | A | 4/1999 | Beaupre et al. | |
| 6,217,424 | B1 | 4/2001 | Stephens | |
| 6,647,579 | B2 | 11/2003 | Manfredi et al. | |
| 6,733,366 | B2 | 5/2004 | Gatton et al. | |
| 2003/0127810 | A1 * | 7/2003 | Meza | 279/110 |
| 2004/0016070 | A1 | 1/2004 | Nemcek | |

OTHER PUBLICATIONS

Force Control Basics Edwin A. Erlbacher, Ph.D. PushCorp, Inc. Force-Control-Basics pdf. Oct. 14, 2004.

* cited by examiner

*Primary Examiner*—Jacob K. Ackun, Jr.
(74) *Attorney, Agent, or Firm*—Bennett Jones LLP

(57) ABSTRACT

A vehicle wheel rim polisher may include: a spindle including a mounting end for accepting a vehicle wheel rim, the spindle being drivable to rotate the mounting end about an axis of rotation, a polishing head support and movement mechanism including a polishing head connector for accepting a polishing head and the polishing head support and movement mechanism being moveable to move the polishing head connector at least substantially radially relative to, and substantially parallel with, the axis of rotation and an automation system including a function for accepting a radial inner position of the polishing head connector, a function for accepting a radial outer position for the polishing head connector and a position control system to maintain the polishing head connector in a selected position with reference to the surface over which polishing is occurring such that the polishing head connector maintains an operating force within a desired range, the force being that generated between any polishing head on the polishing head connector and a vehicle wheel rim, the position control system actuating to drive the polishing head connector in a direction having at least a component parallel to the axis of rotation to maintain the operating force at the polishing head connector within the desired range. A method for using this polisher is also disclosed.

21 Claims, 7 Drawing Sheets

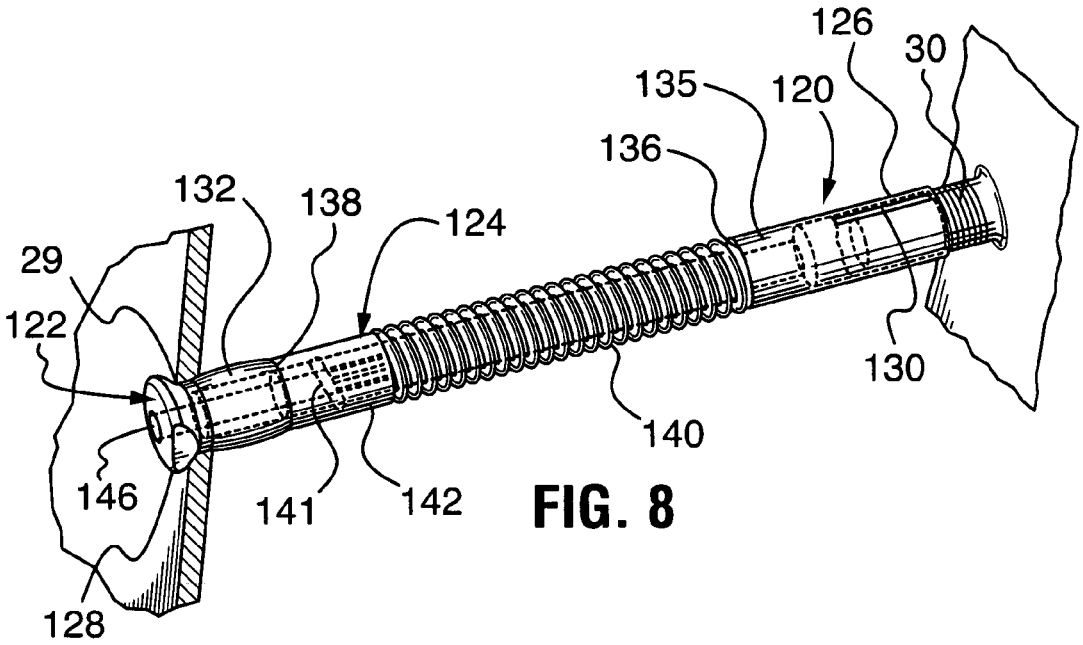
FIG. 8
FIG. 9A
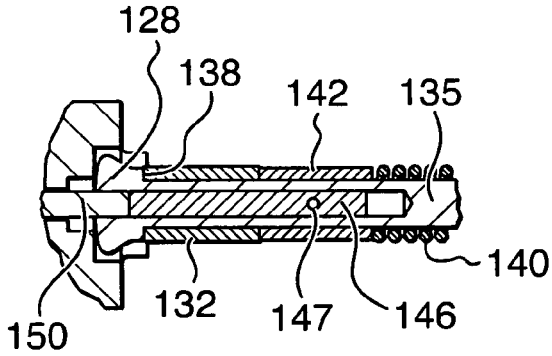
FIG. 9B
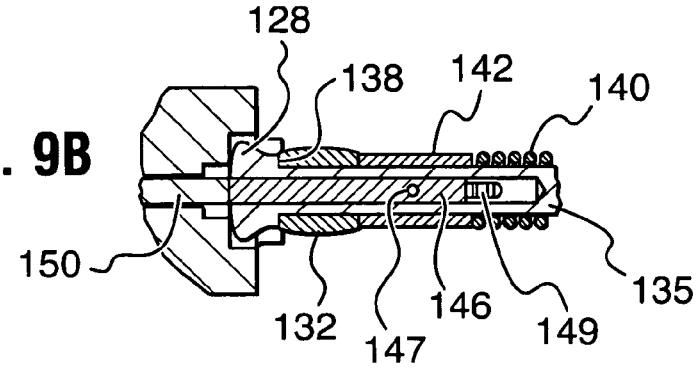

VEHICLE WHEEL RIM POLISHER

FIELD

The invention relates to a vehicle wheel rim polisher.

BACKGROUND

Wheel rims for vehicles are formed to connect a tire to an axle. Wheel rims may be formed to be decorative to enhance the appearance of a vehicle. Many wheel rims therefore have a shiny, mirror-like metal finish. In addition, wheel rims often vary in their surface contour and in their arrangement and form of cutouts.

During manufacture of wheel rims, the rims are polished to have the shiny finish by large and expensive purpose built machines. These machines can produce a high quality finish with a short cycle time using no manual labor. However, in the manufacture process, any particular rim type to be handled by the polishing machines will either be consistent over a large number of polishing jobs or will be selected from one a number of set styles produced. Therefore, little consideration need be given to the problems of polishing many different types of wheel rims.

During use, the surface finish of a rim deteriorates over time. For example, aluminum rims may oxidize and become gray and may become corroded, pitted, or scratched. Thus, vehicle owners may wish to polish the rims in order that the rims regain their shiny finish. When the wheel rims are formed of aluminum, such polishing may require treatment by a polishing head with a polishing compound. Since an automotive shop or vehicle cleaning facility may have to handle hundreds of different rims, the polishing head is generally hand held and operated manually by a person operator. This job is time consuming for a person, rendering it expensive and labor intensive. Further, manual polishing introduces the risk of damaging a rim surface and/or injury to a person and may produce an inconsistent result.

SUMMARY

An automated vehicle wheel rim polisher has been invented. In accordance with one broad aspect of the present invention, there is provided a vehicle wheel rim polisher comprising: a spindle including a mounting end for accepting a vehicle wheel rim, the spindle being drivable to rotate the mounting end about an axis of rotation, a polishing head support and movement mechanism including a polishing head connector for accepting a polishing head and the polishing head support and movement mechanism being moveable to move the polishing head connector at least substantially radially relative to, and substantially parallel with, the axis of rotation and an automation system including a function for accepting a radial inner position of the polishing head connector, a function for accepting a radial outer position for the polishing head connector and a position control system to maintain the polishing head connector in a selected position with reference to the surface over which polishing is occurring such that the polishing head connector maintains an operating force within a desired range, the force being that generated between any polishing head on the polishing head connector and a vehicle wheel rim, the position control system actuating to drive the polishing head connector in a direction having at least a component parallel to the axis of rotation to maintain the operating force at the polishing head connector within the desired range.

In accordance with another broad aspect of the present invention there is provided a method for polishing a wheel rim including a central wheel disc, annular tire retaining flanges extending therefrom and a tire mounted between the tire retaining flanges, the method comprising: providing a vehicle wheel rim polisher including a spindle with a mounting end, the spindle being drivable to rotate the mounting end about an axis of rotation, a polishing head support and movement mechanism including a polishing head connector and being moveable to move the polishing head connector at least substantially radially relative to, and substantially parallel with, the axis of rotation and an automation system including a function for accepting a radial inner position of the head connector, a function for accepting a radial outer position for the head connector and position control system to maintain the polishing head connector in a selected position with reference to the surface over which polishing is occurring such that the polishing head connector maintains an operating force within a desired range, the operating force being that generated between any polishing head on the polishing head connector and a vehicle wheel rim, the position control system actuating to drive the polishing head connector in a direction having at least a component parallel to the axis of rotation to maintain the operating force at the polishing head connector within the desired range; mounting the wheel rim on the mounting end to rotate about the axis; mounting a polishing head on polishing head connector; setting the radial outer position to a position adjacent an annular tire retaining flange of the rim and setting the radial outer position to a position radially inwardly of the annular tire retaining flange on the central wheel disc; and operating the polisher to rotate the rim about the axis of rotation and to drive the polishing head against the wheel rim with the operating force within the desired range while the polishing head cycles radially between the radial outer position and the radial inner position.

BRIEF DESCRIPTION OF THE DRAWINGS

A vehicle wheel rim polisher may be better understood by reference to the following drawings, in which:

FIG. 8 is a side perspective view of a valve stem insertion fixture in use during a wheel polishing procedure.

FIGS. 9A and 9B are axial sectional views of fixtures with unexpanded and expanded elastomeric frictional members, respectively.

DESCRIPTION OF VARIOUS EMBODIMENTS

Figure 1:
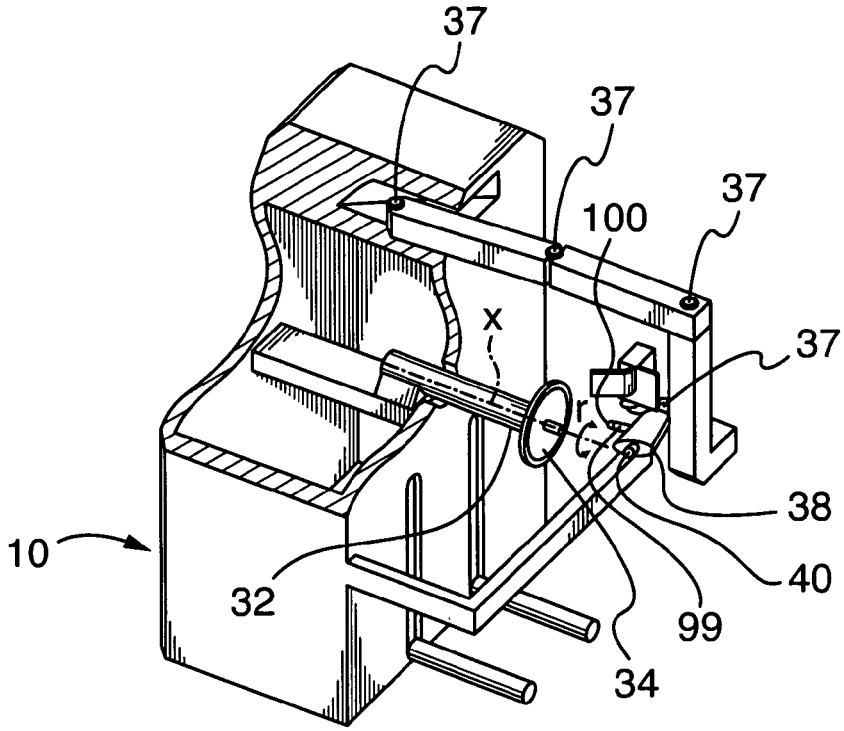
FIG. 1 is a schematic, perspective view of a vehicle wheel rim polisher.
Figure 2:
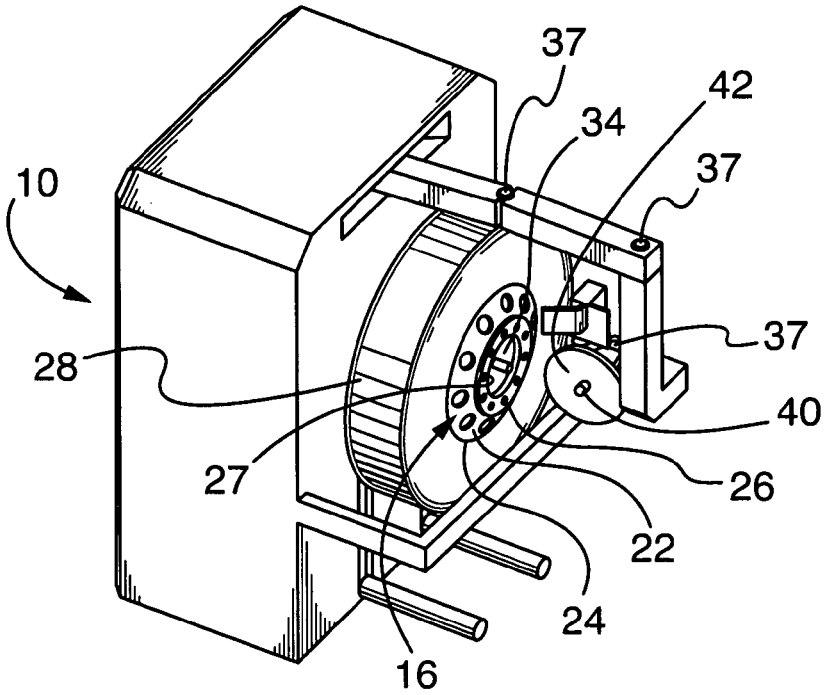
FIG. 2 is a schematic, perspective view of a vehicle wheel rim polisher with a wheel rim positioned thereon.
Figure 3:
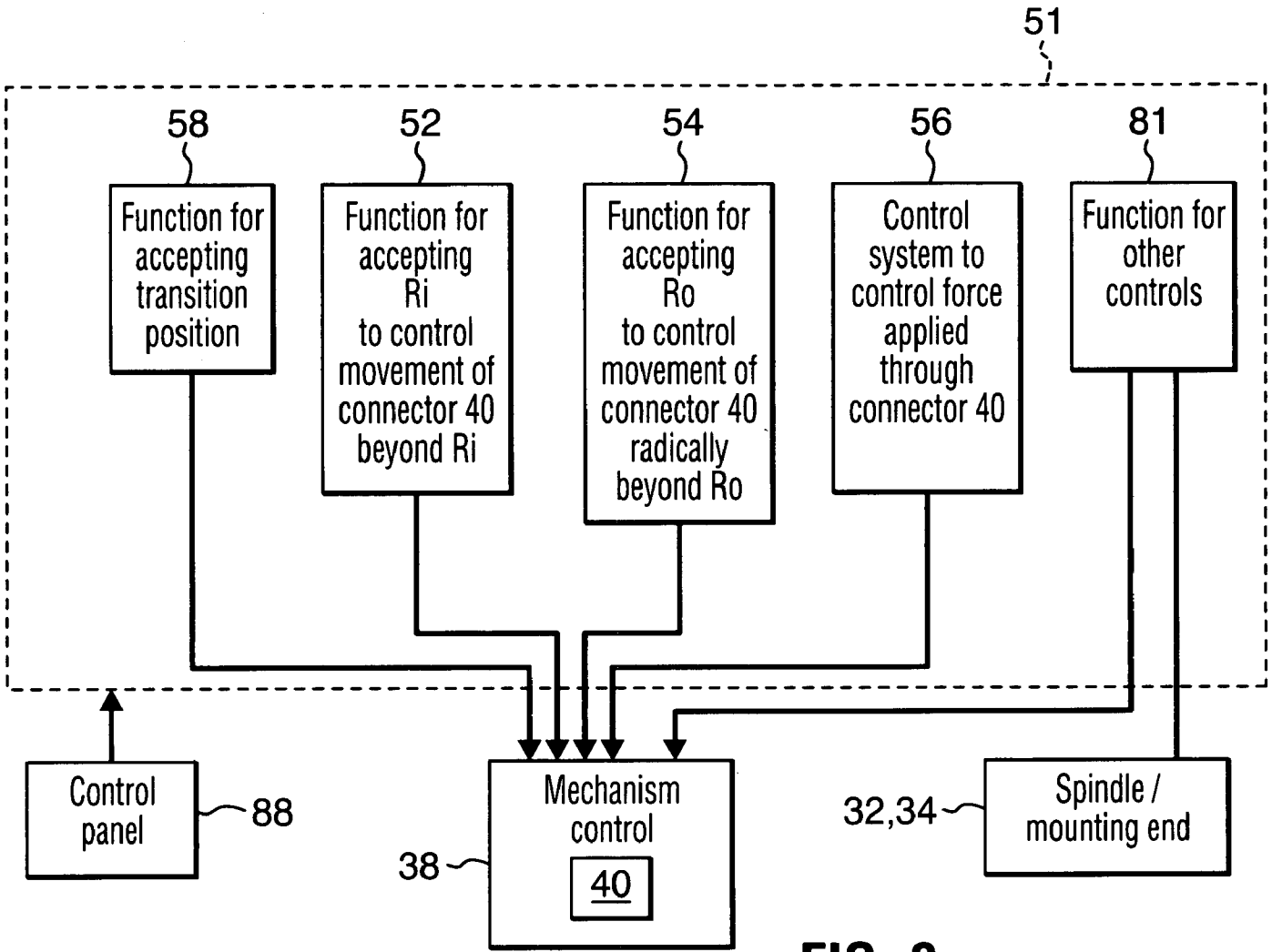
FIG. 3 is a schematic diagram of an automation system useful in a vehicle wheel rim polisher.

Referring to FIGS. 1 to 3, a vehicle wheel rim polisher 10 is shown in accordance with one possible embodiment thereof. Vehicle wheel rim polisher 10 is useful in many applications including new or used rim polishing and/or mass production or single rim jobs. In one embodiment, a polisher as presently described offers a versatile, small and easy to use device for use in refurbishing used rims in truck repair shops, tire shops and truck stops.

A wheel rim 16 may include a central wheel disc 22 and annular tire retaining flanges, one of which is shown at 24, extending therefrom. The central wheel disc is generally formed closer to one annular flange than the other to form a deeply concave side, termed the drive rim surface, and an opposite side, termed the steer rim surface, which may be gently concave, flat or convex. Both the steer and the drive rim surfaces may have profiles including curvature changes and openings. The profiles may vary significantly from rim-type to rim-type. The steer side surface generally is mounted against a vehicle axle (not shown) and the central wheel disc includes a plurality of holes 26 to accept the axle bolts. Central wheel disc 22 often includes a hub cutout 27 centrally positioned thereon. In use, a vehicle wheel rim has a tire 28 mounted between the annular tire retaining flanges and includes an aperture 29 (FIG. 7) through which the tire's valve stem 30 (FIG. 7) extends. As will be better appreciated hereinafter, wheel rim polisher 10 may be useful to support and polish a wheel rim with a tire still mounted thereon. This may be useful to eliminate the extra time needed to separate and remount the tire and the rim during a polishing operation.

Vehicle wheel rim polisher 10 may include a spindle 32 including a mounting end 34 for accepting a vehicle wheel rim 16 as by direct or assisted engagement therebetween and a polishing head support and movement mechanism 38 mounted in spaced relation from the spindle. Polishing head support and movement mechanism 38 includes a polishing head connector 40 for accepting a polishing head 42 thereon. Spindle 32 may be drivable to rotate the mounting end, as shown by arrows r, about an axis of rotation x. Movement mechanism 38 may be moveable to move the polishing head connector through a direction having a vector component substantially radially relative to, and a vector component substantially parallel with, axis of rotation x.

The various components of the vehicle wheel rim polisher may take various forms. For example, the polishing head may be a pad or wheel, for example, formed of cloth, composite materials, sandpaper, flaps, sisals, etc. and the polishing head connector may likewise take various forms in order to secure and operate the polishing head. The spindle may take various forms such as fixed, telescopic, etc.

Vehicle wheel rim polisher 10 may further include an automation system 51, such as is diagrammatically illustrated in FIG. 3, including a function 52 for accepting a radial inner position Ri of the wheel connector relative to the axis x, a function 54 for accepting a radial outer position Ro for the wheel connector relative to the axis x and a position control system 56 that operates the polishing head connector with reference to the work piece rim surface contour to maintain an operating contact pressure at the polishing head connector and to drive the polishing head connector in a direction including at least a component parallel to the axis of rotation to maintain any polishing head on the polishing head connector in contact with any rim on the spindle.

The position control system may be any one of various mechanisms and/or systems that can operate with reference to a work piece surface contour including, for example, a force compliant system, a pressure sensing feed back system, a proximity sensor, a tracer, a real time or operational sensing device, etc. In one embodiment, for example, the position control system may be a force compliant system such as one described by PushCorp, Inc., in for example the paper entitled "Force Control Basics" available at www-.pushcorp.com/Tech%20Papers/Force-Control-Basics.pdf. Such a force compliant system may be useful to maintain the polishing head connector in a position to maintain a polishing head operating pressure within a defined range. The operating pressure is that generated between a polishing head on the polishing head connector and a vehicle wheel rim. By selection of the operating pressure range, the automation system can ensure that the polishing head remains in contact with the rim, regardless of the curvature thereof and without being programmed with the actual curvature profile of the rim.

Figure 4:
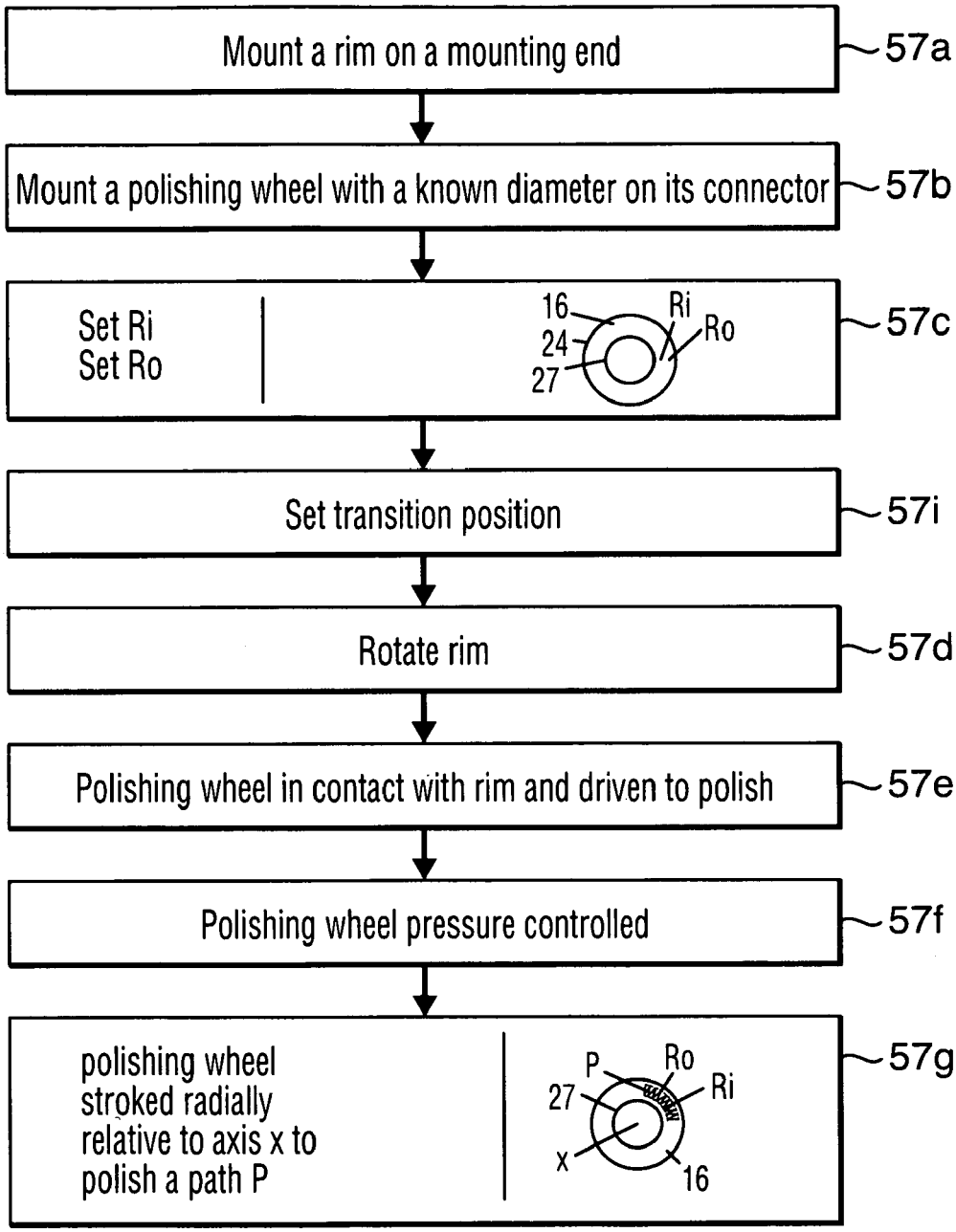
FIG. 4 is a schematic diagram of a method for operating a vehicle wheel rim polisher.

With reference to FIG. 4, a method is diagrammatically illustrated to facilitate understanding. Of course, it will be appreciated that many of the steps may be altered in their sequence and the order of the steps is not to be limiting in consideration of the method. To polish a rim, the rim may be mounted 57*a* on a mounting end of a polisher. In such a mounted position, the rim may be rotated about axis x by the polisher. A polishing head 42 may be mounted 57*b* on polishing head connector 40 either before or after the rim is mounted. In some methods, the automation system may require an input of the polishing head diameter and this can be determined and input prior to the polishing operation. Again, either before or after the polishing head and the rim are mounted, the radial inner position Ri and the radial outer position Ro of the connector may be set 57*c* using the automation system. The radial outer position may, for example, be set to a position adjacent an annular tire retaining flange 24 of a rim 16 and the radial outer position may be set to a position on the central wheel disc radially inwardly of the annular tire retaining flange. The polishing head may then be driven 57*e* against the rim and the polisher may then be operated to rotate 57*d* the spindle, and thereby the rim, about axis x with the polishing head bearing 57*f* against the wheel rim, as determined by the position controller. In one embodiment, the position control system may include a pressure controller and will seek to maintain the pressure at the polishing head connector within a defined range. As will be appreciated, the pressure at the pressure controller is indicative of that force generated as the polishing head bears against the wheel rim. The polishing head is cycled 57*g* radially back and forth between the radial outer position Ro and the radial inner position Ri, from any starting point, by the automation system. The radial motion together with the rotational movement of the wheel rim, as driven by the spindle and mounting end 34, causes the polishing head to trace along the rim surface to form a polished annular path P about axis x with the path width extending between Ri and Ro. As desired, the polishing head may remain in contact with the rim through the radial cycle or may only be in contact with the rim during only one of the radial outward or radial inward (from Ro to Ri) portions of the cycle.

The radial outer position may, for example, be set to a position adjacent an annular tire retaining flange 24 of a rim 16 and the radial inner position may be set to a position on the central wheel disc radially inwardly of the annular tire retaining flange. The radial outer position may be at an outermost edge of the annular tire-retaining flange or at a position adjacent but spaced radially inwardly from the annular tire-retaining flange, as at a transition point. The use of a radial outer position limits the outward movement of the polishing head such that a polishing operation may proceed while the tire remains on the rim. In particular, the radial outer position can be selected to prevent the polishing head moving out into contact with the tire. The radial inner position may, for example, be a substantially central position on the central wheel disc or an intermediate position somewhere between the central position and the annular tire-retaining flange.

The automation system may further include a function 58 for accepting a transition position between the radial inner position and the radial outer position and the method may further include setting 57*i* this transition position. Function 58 may be useful where there is a significant curvature change along the rim that may require reorientation of the polishing head, for example with respect to its plane of rotation, to adequately bear against the rim surface.

By use of the term polishing herein it is to be understood that this encompasses any method of rubbing the polishing head against the wheel rim. It will be appreciated that some such procedures may have more precise descriptions such as cutting, coloring, buffing, etc., but they are herein covered by the term polishing. For example, in one method for aluminum polishing, polishing steps may include one of a plurality of types of polishing heads and one of a plurality of types of polishing media for cutting, coloring and then buffing to achieve a particular polished surface.

Figure 5:
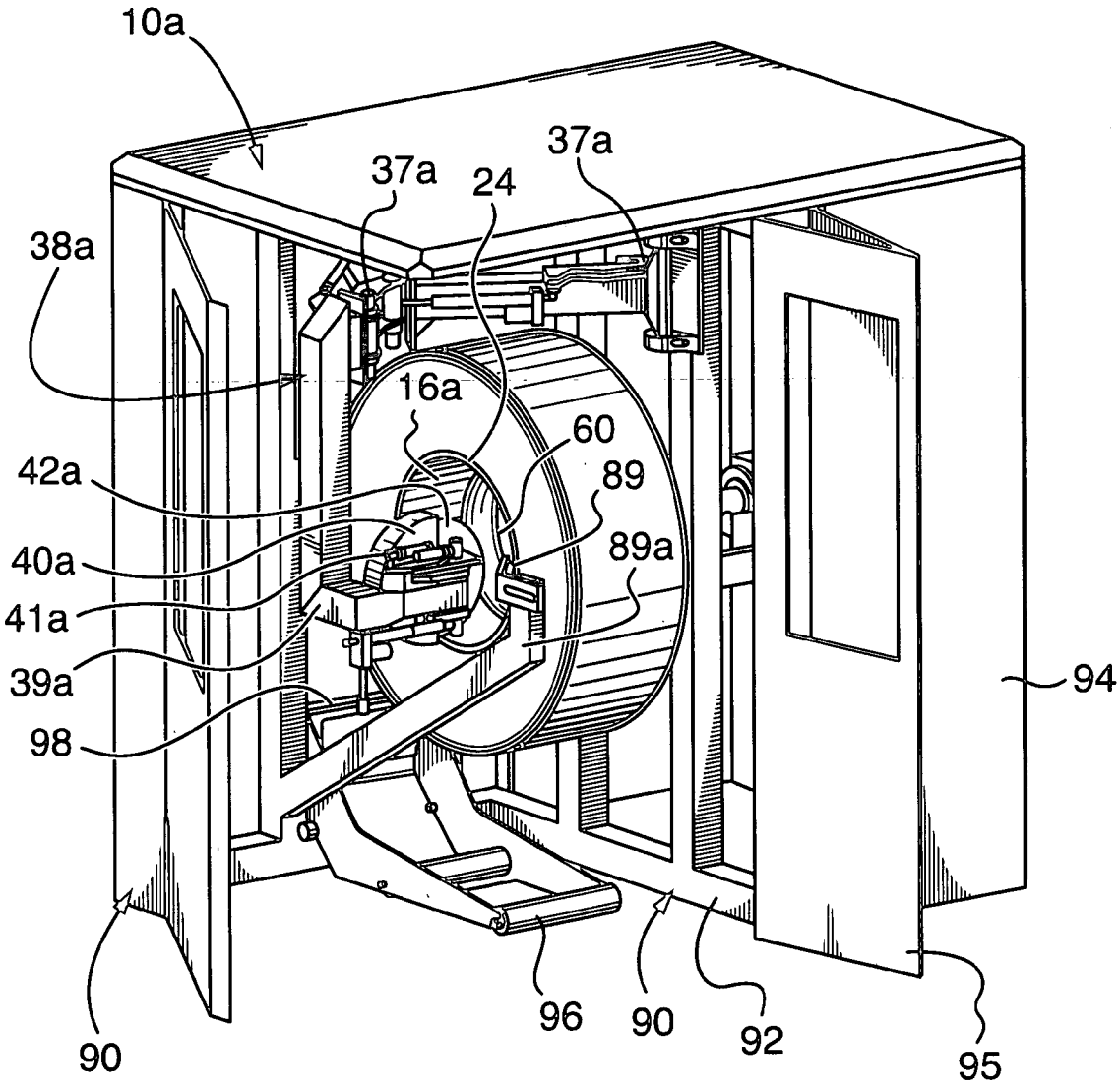
FIG. 5 is a perspective view of a vehicle wheel rim polisher with a wheel rim positioned therein.
Figure 6:
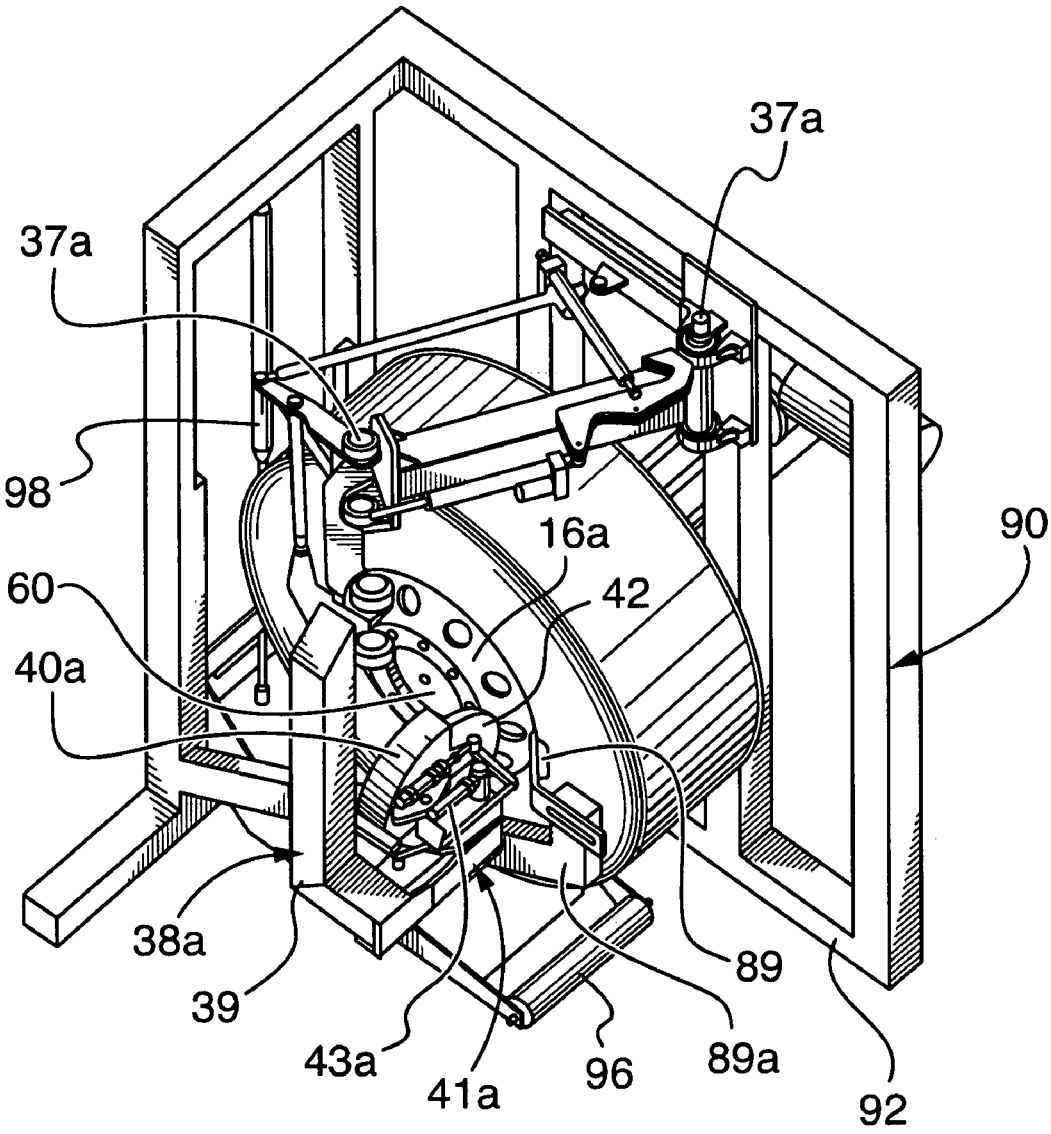
FIG. 6 is a perspective view of a vehicle wheel rim polisher with the outer housing removed.

Another embodiment of a vehicle wheel rim polisher 10*a* is shown in FIGS. 5 and 6. Polisher 10*a* includes a spindle with a mounting end, neither of which can be seen as they are disposed behind a wheel rim 16*a* mounted thereon and a polishing head support and movement mechanism 38*a* including an arm 39*a* with a polishing head region 41*a* at one end thereof, and in the polishing head region, a polishing head connector 40*a* for securing a polishing head 42*a*.

A spindle, such as item 32 in FIG. 1, may be formed in various ways to define, and to allow for rotation of, mounting end 34. In one embodiment, the spindle and the mounting end rotate together as driven by a motor. A capability of variable speed rotation, for example between 0 and 50 or more rpm, and rotation in both the clockwise and counter-clockwise directions may be useful. The spindle may also, in one embodiment, include a telescoping feature to permit adjustment of the mounting end relative to the wheel to be loaded thereon and to permit adjustment of the mounting end and wheel after the wheel has been installed. In another embodiment, an insert may be provided for installation between the mounting end and the wheel rim so that the relative distance therebetween can be selected.

A mounting end, such as item 34 in FIG. 1, may be formed in various ways to accept and support a wheel rim. The mounting end may be formed to accept a range of rim sizes (diameters) and a range hub mounting configurations. In one embodiment, for example, the mounting end may include bolts or threaded collars or apertures mounted thereon and positioned to pass through or line up with at least some holes 26 in the wheel disc to accept nuts or threaded fasteners. In the embodiment of FIG. 5, the mounting end is formed to retain a faceplate 60 formed to clamp against the rim. In one embodiment for example, faceplate 60 includes a shoulder for supporting a hub cutout of the wheel rim and a clamping plate is formed to be secured thereover and to the mounting end. The mounting end and the clamping plate, for example, may include threaded connections that permit threaded engagement of the clamping plate against the mounting end with the faceplate engaged on the rim and sandwiched between the clamping plate and the mounting end. In one embodiment, the clamping plate may be formed to be capable of hand threading to the mounting end so that no tools are necessary. A lock pin can be used to secure the plates against working loose during operation.

In one embodiment, the mounting end accepts and retains the wheel rim such that its annular flanges 24 are concentric about axis x, such that the radial distance between axis x and annular flange 24 in a direction relative to the axis, for example horizontally to the right, remains substantially constant while the rim is rotated.

Axis of rotation x may assume various orientations, as desired. In one embodiment, however, an axis of rotation x that is closer to horizontal than to vertical may be used such that the polisher footprint, and thereby its floor space requirements, are significantly reduced over an apparatus that rotates a rim through a vertical or near vertical axis. In one embodiment, the spindle and/or mounting end are configured such that the axis of rotation may be substantially horizontal. A substantially horizontal axis configuration wherein the wheel is held with the annular flange in a substantially vertical plane may also be useful to facilitate loading and unloading a wheel to the polisher, as will be described hereinbelow.

Polishing head connectors 40, 40*a*, as will be appreciated, may also take various forms to secure and permit operation of a polishing head connected thereto, for example depending on the form of polishing head used. A connector may generally include a support such as a journal, an axle, a gear, a keyed rod, a bearing, etc. to fit through a hub on the polishing head. A releasable locking mechanism, such as a nut, clamp, pin, etc. may be used to releasably lock the polishing head on the support.

Polishing head support and movement mechanisms, 38, 38*a* may also take various forms and configurations. While each provide a polishing head connector 40, 40*a*, the Figures show two possible options for support and movement of the polishing head connector and thereby the polishing head. In FIG. 1, mechanism 38 includes a plurality of pivotal connections 37 that provide for movement of polishing head connector 40, and thereby any polishing head connected thereto, at least substantially radially and substantially parallel relative to axis x. FIG. 5 illustrates an embodiment wherein mechanism 38*a* includes arm 39*a* with a polishing head region 41*a* at one end thereof. Arm 39*a* includes a plurality of pivot points 37*a* driven by hydraulic cylinders or possibly other drive means. Parallel linkages may be used to facilitate movement and positioning.

Polishing head region 41*a* includes a drive system 43*a* on which polishing head connector 40*a* is supported. Drive system 43*a* includes components for driving movement of polishing head connector 40*a* at least substantially radially and substantially parallel relative to axis x. Drive system 43*a* may include mechanical linkages, solenoids, screw drives, hydraulic or pneumatic cylinders, etc. and motors for driving these components such as pneumatic, hydraulic, electric, etc. In one embodiment, shown in FIG. 7, a drive system 43*a* is used including electromechanical actuators including components such parallel linkage arrangements 44 and hydraulic cylinders 45.

The movement of the polishing head connector substantially radially relative to axis x may permit a polishing head on the connector to be moved back and forth along a radial path relative to the axis x. The movement of the polishing head connector substantially parallel relative to axis x may permit a polishing head on the connector to be moved against and retracted from contact with a rim mounted on the spindle and maintained in contact with the rim to trace along a profile of the rim following the curvature as the wheel is moved back and forth radially relative to the axis x.

Polishing head support and movement mechanisms, 38, 38*a* may also include a drive for rotating polishing head connector 40, 40*a* to drive rotation of the polishing head, as may be required to effect a polishing action. Of course, many possible drives for such rotation may be possible. A rotational drive motor 46 may be used for the polishing head connector in one possible embodiment and may include a variable speed drive for operation in one or both rotational directions. The rotational speed may be varied based on various parameters such as the diameter of the polishing head and the nature of polishing to be achieved (cut, color, buff, etc.).

Useful polishing head support and movement mechanisms may also include a pivot 47 and related drive to permit selection of the plane of rotation of the polishing head relative to axis x of the mounting end. Of course, the plane of rotation of the polishing head is determined by the position of the polishing head connector. Positional selection of the polishing head plane of rotation permits the bearing surface of the polishing head to be adjusted to more readily and effectively bear against a rim mounted on the mounting end. Such a pivot may require a drive system including for example, a hydraulic or pneumatic drive cylinder, a gear, a solenoid, a motor or other means.

To reduce the clutter of the mechanism and the number of components adjacent the polishing head connector, it may be appreciated that some components such as motors, controllers, etc. could be located away from the connector and fluid or electrical communication lines could be provided to communicate with the polishing head connector.

Movement of the polishing head connector may be controlled by an automation system, for example as illustrated in FIG. 3. The automation system may be analog-based or logic-based, as desired. The automation system controls the polishing head support and movement mechanism 38, 38*a* to direct the path width and stroke pressure of the polishing head connector and therethrough the polishing head over the rim being polished. For example, polishing head region 41*a* including drive system 43*a* thereof may be controlled to stoke over a rim surface with a defined operating pressure range through a defined path. As noted previously, the automation system may include function 52 for accepting a radial inner position of the polishing head connector, function 54 for accepting a radial outer position for the polishing head connector and position control system 56 that operates with reference to a work piece rim surface contour and controls the polishing head connector to drive it in a direction having a component at least parallel to the axis x of rotation to maintain a selected pressure at the wheel connector relative to the rim. That pressure corresponds to the pressure generated between a polishing head on the polishing head connector and the vehicle wheel rim on which the polishing head is acting.

The inner and radial outer positions are input to the polisher to determine the range of motion of the polishing head connector as it moves radially back and forth during operation. These positions, then, effectively create stops at which the polishing head is reversed from movement in one radial direction to then move back along the same or a similar radial path, either while continuing in contact with or lifting off the surface.

Functions 52, 54 for accepting radial inner and radial outer positions for the wheel connector may take various forms. The functions may be based on mechanical means, position logic memory, location sensors (i.e. feelers, sensors), rim size database information, or combinations thereof. For example, in one embodiment, the functions accept radial inner and radial outer positions based on an input of information, the input may be by a measurement of the radial inner and radial outer positions from the point of axis x of a rim to be polished, which measurements are input to the automation system as by numerical entry. Alternately, the functions may be based on mechanical stops positioned on or adjacent the polishing head connector or drive system that physically limit the range of motion. In another embodiment, the functions may accept input based on a manual or mechanically driven positioning of the polishing head connector to the desired position and then storing this position in a memory component of the function. For example, using a force compliant mechanism, the polishing head connector with a polishing head connected thereto can be moved and pressed against the surface at the Ri and/or Ro position. When the force compliant mechanism senses a load, from contact with the surface, the position of the polishing head connector is recorded and stored. In particular, the position of arm 39*a*, for example with respect to pivots 37*a* and their associated drive components, and the position of drive system 43*a* components, such as cylinders 45 and parallel linkages 44, are recorded and stored by the functions 52, 54 so that the automation system can determine when a point Ri or Ro is reached and/or to which position the arm and drive system should be relocated in order to locate the polishing head at Ri or Ro. Where polishing head diameters may change during a process once the radial positions are set, as by change out of head for different process steps, the functions may require input of polishing head diameter to ensure that the positions of arm 39*a* and drive system 43*a* adjust for a diameter change. The automation system may include an automatic head diameter measuring function in order to facilitate proper head positioning. The functions 52, 54 may include a reset option for reteaching any position.

Functions 52, 54 may also be useful to record and store the positions of the plane of rotation of the polishing head at Ro and Ri. The position of plane of rotation of the polishing head may be taught by recording the relative positions of pivot 47 and its related drive components.

Function 57 may also be provided to establish a transition position where the polishing head connector and the polishing head thereon will be reoriented, as by pivoting the connector to adjust the plane of rotation of the polishing head relative to axis x. Function 57 can include, for example, one of the possible mechanisms as described above with reference to functions 52, 54.

Position control system 56 in one embodiment maintains the operating pressure at the polishing head connector to drive the polishing head connector at least in part parallel to the axis x of wheel rim rotation so that a selected operating pressure range is maintained at the polishing head connecter, which is indicative of that pressure between a polishing head on the polishing head connector and the vehicle wheel rim. This ensures that contact is maintained between the rim and the polishing head throughout operation, regardless of the surface contour changes and without reference to a stored program of the surface contour.

As noted hereinbefore, position control system 56 can be provided through various mechanisms and configurations. One possible embodiment may be better understood with reference to the embodiment of FIG. 7. The polishing head pressure on the rim may be, for example, 10 to 60 lbs of force. The force modulation may be controlled by various means. In the illustrated embodiment, force modulation is controlled by means a pressure controller such as a force compliant mechanism incorporated into the parallel linkage 44 and hydraulic cylinder 45 of the drive system. These mechanisms work in concert to continuously maintain a selected operating pressure range. Pressure modulation of +/−10 lbs or +/−5 lbs appears acceptable. The acceptable pressure range may vary on any particular rim from one rim area to the next, if desired. Of course, position control system 56 may require damping means so that the system does not overreact to decorative or venting cutouts or openings that may be present in rim profiles.

The force compliant mechanism senses and reacts to forces on the connector by altering the connector position through the drive system's components, which in this embodiment are the parallel linkage 44 and hydraulic cylinder 45. In one embodiment, for example, the force compliant mechanism includes an air over hydraulic cylinder controlled by an analog pressure regulator to continuously adjust the location of the polishing head connector. Linear actuators, bearings etc. of the drive system can be selected to minimize vibration and to provide responsive and smooth motion in response to pressure changes.

The automation system may be useful for automation of other aspects of the polisher function 81 such as control of the mounting end speed of rotation, safety shut down, etc. In one example, position control system 56 may be useful to provide a safety shut down in response to a sudden drop in pressure that would occur should the polishing head lift off the surface of the rim.

The automation system may include a control panel 88 for ease of operation. The control panel could, for example, be based on relay driven operation or alternately, a menu driven touch screen where computerized or programmable logic control is used.

Since polisher head contact with the tire of a wheel may create safety concerns, a stop block 89 may be fitted on the polisher along the radial path traveled by the polisher head. Stop block 89 may be mounted on the polisher, as by an arm 89*a*, which is moveable to a position adjacent, the annular tire retaining flange. In this position, the stop block would protect the tire from abrasion by the polishing head, should the position Ro be incorrectly set, etc.

As will be appreciated, the spindle, the polishing head support and movement mechanism and the automation system may be assembled into a unit. Such a unit may include a structural frame 90 including a base portion 92 that supports the parts of the polisher. It may be formed with consideration to any or all of ease of handling, construction and installation, durability, minimum footprint, ease of leveling, provision for anchoring, etc. The polisher may include a housing 94 about structural frame to protect the parts and to protect against personal injury. Of course, the housing may include access doors 95 and panels, where desired.

In order to facilitate use of the polisher, a wheel lift assembly may be provided. In one embodiment, the wheel lift assembly may be selected to permit a wheel or a rim to be rolled thereon, so that the wheel or rim need not be lifted separately. Since a wheel is easiest to move by rolling on its tire, or on its annular flange 24 if no tire is installed, it may be useful that the wheel lift assembly accepts a wheel in a vertical position, so that the wheel need not be laid on its side. In one embodiment, the wheel lift assembly includes a support platform 96 or cradle onto which the wheel is rolled and a lift mechanism 98 for raising platform 96 and the wheel or rim supported thereon to a position wherein its rim is adjacent the mounting end of the spindle. Support platform 96 is connected to lift assembly and is configured to be positionable adjacent base portion 92 of the frame, which may be adjacent the support surface on which the polisher is positioned. Lift mechanism 98 may include various components for lifting a wheel. In one embodiment, lift mechanism 98 may include a hydraulic drive and platform 96 may be connected thereto. The lift mechanism may include a guard, as shown by arm 89*a*, to prevent the wheel from falling over when in the lift.

The wheel lift assembly may be operator driven and should be selected with consideration as to the weights and diameters of wheels to be lifted. The automation system may include functions for safety and control of the lift assembly. For example, the automation system may include a safety feature that prevents wheel lift operation if the polishing head connector is operating or which senses the wheel lift or wheel position and limits upward stroke to prevent over lift or disables the rotation of the spindle mounting end if the lift assembly has not be removed from its supporting position under the wheel.

The polisher may operate with polishing media. Many forms of polishing media are available, including liquid and solid forms. For example, with reference to FIG. 1 the present polisher may include a polishing media supply system including a reservoir, a supply hose 99, a media control valve and a spray nozzle 100 adjacent the connector, for example at polishing head region 41*a*. If the polishing operation requires more than one kind of polishing media, further reservoirs, hoses, etc, may be required. In another example, shown in FIG. 7, the polishing media is in the form of a solid bar in a holder 102 supported adjacent the polishing head region 41*a*. The holder may also provide a dressing station for the polishing head.

Since the polisher may generate dust during operation, the polisher may alternately or in addition include a dust collection system. The dust collection system may include a dust collection head 110 adjacent connector 40*a*, duct 112 extending from head 110 and a vacuum system for drawing air through the head and the duct. Since the dust may sometimes be harmful or its release may be environmentally restricted, the dust collection system may also include a dust reservoir. Blowers may also be provided to create positive pressure in certain areas to discourage collection of dust. Such blowers may be fed by exhaust air bleed of the dust collection system.

In a method of polishing a vehicle rim, the method may include bringing a wheel (or a wheel rim without a tire thereon) to a polisher, such as one of those disclosed above. With respect to FIGS. 5 and 6, the method may include rolling the wheel onto the support platform of the wheel lift assembly and operating the lift assembly to position the rim adjacent the mounting end of the spindle. The rim may then be secured to the mounting end and the lift assembly operated to lower the support platform out of engagement with the wheel, for example to a fully lowered position. With the rim secured on the spindle, the polishing head support and movement mechanism and the automation system may be used to input the radial inner position and the radial outer position on the rim to be polished, as for example by positioning the polishing head connector with the head thereon and establishing a set point by applying a load to a force compliant system and automation system. The radial inner and outer positions may vary, as described above, depending on the area of the rim to be polished. An intermediate, transition position may also be input to the automation system, if desired. If not already installed, a polishing head may be installed onto the polishing head connector. Then the polisher may be operated to polish an annular path about the rim as defined by the radial inner and outer positions and the speed of rotation of the mounting end. Polishing media may be applied if desired, as by application from a polishing media supply system. The method may include a plurality of polishing steps including for example one or more of a cutting step, a color step and a buffing step. Such steps may require installation of particular polishing heads and the application of particular polishing media. During operation, a dust collector, if provided, may be operated to remove dust arising from the polishing process. The automation system may be used to control the polishing operation. For example, the position control system may be used to ensure that the polishing head is maintained in contact with the rim by reference to the surface of the rim and regardless of the surface curvature thereof. For example, using a force compliant system, pressure modulations detected in the polishing head connector are reacted by moving the connector closer to or away from the rim with a drive mechanism. After polishing is deemed complete, the wheel is removed from the mounting end and lowered via the wheel lift assembly such that it can be removed.

Figure 7:
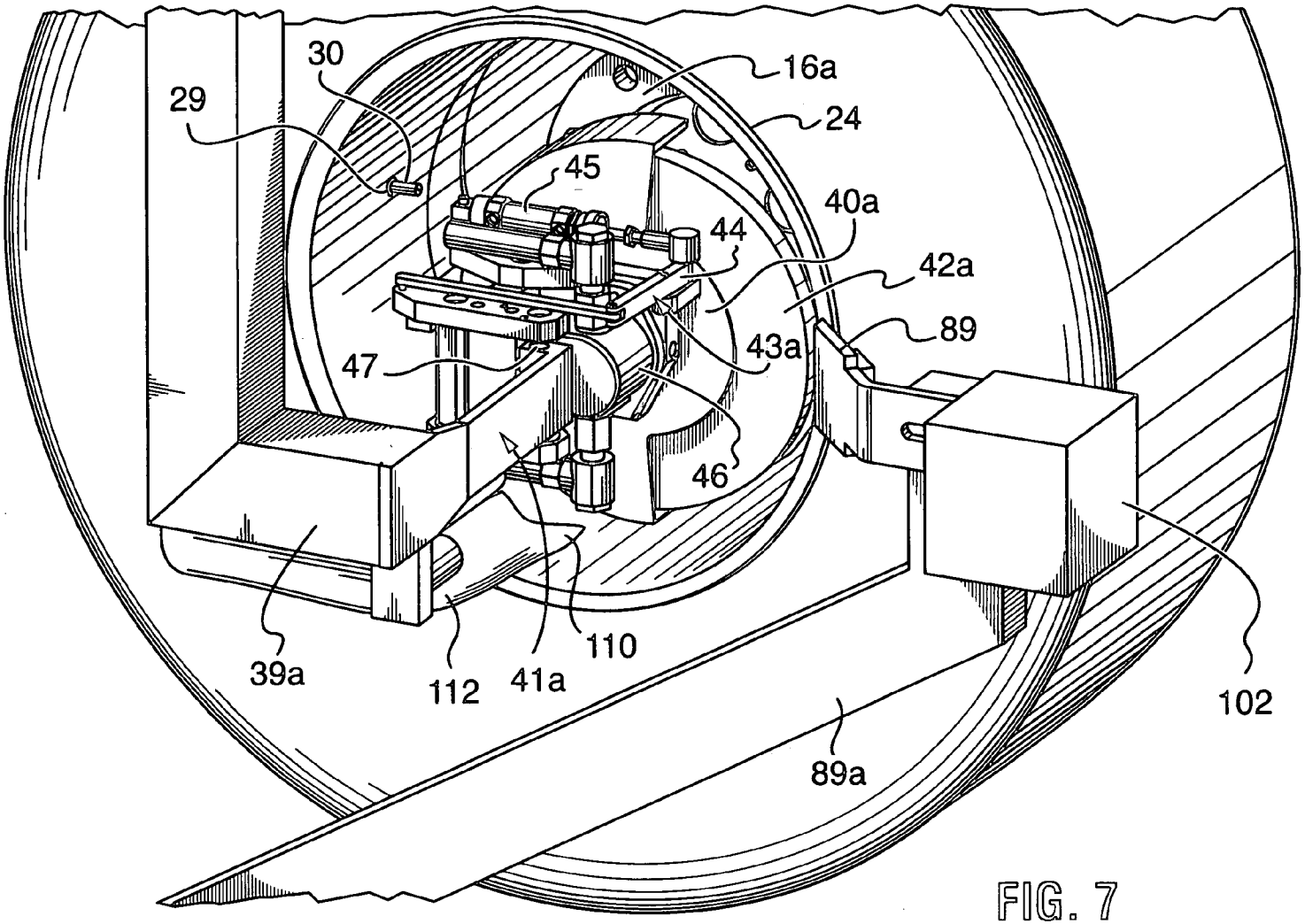
FIG. 7 is an enlarged view of a polishing head region of a vehicle wheel rim polisher.

In one embodiment, a wheel to be polished may include a valve stem, such as item 30 of FIG. 7, which may interfere with the movement of the polishing head over the rim. In such a situation, it may be reasonable to remove the tire from the wheel rim such that the valve can be removed. However, this creates extra work in removing and reinstalling the tire. Thus, in one method, the tire is deflated and the valve stem is pushed into the tire, for example through valve stem aperture 29, such that it does not protrude into the rim area to be polished. Thereafter the rim can be polished without concern of being hindered by the position of the valve stem. In one such method, the valve stem may be engaged by a valve stem insertion fixture and may be inserted into the tire while remaining engaged to the fixture. The fixture may then be mounted to the valve stem aperture in the rim such that an end of the fixture remains accessible through the valve stem aperture and can be pulled back out with the valve stem engaged thereto. Any such fixture may be formed to engage the valve stem fixture, be insertable at least in part through the valve stem aperture and be mountable in or adjacent the aperture to remain accessible such that it can be pulled back through the aperture. As will be appreciated, a suitable fixture should be sized and formed such that, when in the mounted position, it does not itself create a significant obstruction to rim polishing.

With reference to FIG. 8, a useful valve stem insertion fixture is shown mounted in a valve stem aperture. The fixture includes a first end 120 forming valve stem grip, a second end 122 including an aperture grip and a body 124 therebetween. The tool along first end and at least a portion of the body is formed with a maximum diameter that is less than the maximum diameter of the valve stem aperture such that these portions of the fixture can be inserted through the aperture. A head 128 may be formed on second end 122 which is larger, at least in one dimension, than valve stem aperture so that it butts against the aperture but cannot pass therethrough. This permits the fixture to be inserted through an aperture 29 until it is stopped by head 128, so that even while the fixture is mostly installed in the tire, the head can be accessed from the rim surface.

The valve stem grip may take various forms. In the illustrated embodiment, for example, the valve stem grip includes a threaded collar 126 for threading onto the threads of valve stem 30. Collar 126 can include one or more slits 130 to permit collar expansion during engagement over the stem to allow for ease of fit.

The aperture grip at second end may also take various forms including for example, threads, snap grips, elastomeric frictional means, etc. The illustrated embodiment shows an elastomeric frictional member 132 having a diameter, either normally or when activated, that is larger than the diameter of the aperture 29. Elastomeric frictional member 132 is adjacent to or spaced from head 128 toward end 120 so that fixture may be installed into aperture 29 and the aperture may be positioned with the fixture head on one side and the elastomeric member 132 engaging on the other side. Member 132 can be forced through the aperture, by elastomeric deformation, and once through will expand or can be expanded to prevent passage again through the aperture without either application of force to squeeze member 132 back through the aperture or, if possible, release of the force that causes expansion of the member.

The fixture of the illustrated embodiment, includes a member 132 that only defines a diameter significantly greater than a valve stem aperture diameter by application of force thereon to expand it. Thus, in a neutral condition, as shown in FIG. 9A, member 132 has a diameter that can fit relatively easily through a valve stem aperture. However, member 132 can be expanded, as shown in FIGS. 8 and 9B, to increase its diameter such that it cannot easily pass through aperture 29. To activate this member, the fixture may include, for example, a mandrel 135 including a first shoulder 136 and a second shoulder 138 facing the first shoulder. Between shoulders 136 and 138 and about mandrel are an expansion spring 140 and member 132, which is formed as a sleeve. In the illustrated embodiment, a force transmission sleeve 142 is positioned between spring 140 and member 132 to more evenly distribute force from the spring to the elastomeric member. As such, shoulders 136 and 138 act as stops to limit movement of the spring, the sleeve and the member along the mandrel. The expansive force of spring 140 can bias sleeve 142 against member 132, such that member 132 becomes compressed between the sleeve and shoulder 138. This causes member to be expanded outwardly between sleeve 142 and shoulder 138 thereby increasing the outer diameter of the member. Mandrel 135 further carries a pin 146 in communication with spring 140, which communication in the illustrated embodiment is by engagement of the pin with sleeve 142 through a lateral pin 147 extending through a slot 149 in mandrel 135, and which can be moved to bias the spring against its expansive force to remove the force compressing member 132 between sleeve 142 and shoulder 138. Thus, pin 146 can be moved to bias spring 140 against its expansive force to reduce or remove the force from member 132. Mandrel 135 may be formed in parts to facilitate assembly of the fixture.

In use, the fixture of FIGS. 8 and 9 can be prepared for installation by threading collar 126 onto a valve stem 30 and then actuating pin 146 to compress spring, such that member 132 defines a substantially unexpanded diameter. This can be done, for example, by driving pin 146 with a tool 150.

With member 132 in the unexpanded condition, the fixture can be inserted into the aperture until head 128 stops further insertion. In this position, the aperture will be positioned between head 128 and elastomeric frictional member 132. At that point, pin 146 can be released so that the spring force is free to act on sleeve 142 and member 132. This causes member 132 to expand and engage against passage again through aperture 29.

A rim polishing procedure can then be carried out.

When it is desired to remove the fixture from the aperture, pin 146 can again, as by use of tool 150, be moved to drive spring against its expansive force, which will relieve the force from member 132 such that the member can return substantially to its unexpanded position, in which position the member can be passed again through the aperture. In drawing the fixture outwardly through the aperture, valve stem 30 is drawn through aperture 29 and into its sealing position so that the tire can be inflated.

Head 128 will be exposed on the rim surface where polishing is desired. Thus, it may be useful if head 128 of valve stem insertion fixture is formed of a durable material, but one that does not cause sparks when engaged by a polishing head. Head 128 may also have a low profile and/or, to facilitate engagement thereof for removal, flats 154 or a threaded area, may be formed thereon.

Although various embodiments of the invention have been described and shown herein, such embodiments are included only for illustrative purposes to facilitate understanding. Such embodiments should not be used to limit the claims appended hereto.

What is claimed is:

1. A vehicle wheel rim polisher comprising: a spindle including a mounting end for accepting a vehicle wheel rim, the spindle being drivable to rotate the mounting end about an axis of rotation, a polishing head support and movement mechanism including a polishing head connector for accepting a polishing head and the polishing head support and movement mechanism being moveable to move the polishing head connector at least substantially radially relative to, and substantially parallel with, the axis of rotation and an automation system including a function for accepting a radial inner position of the polishing head connector, a function for accepting a radial outer position for the polishing head connector and a position control system to maintain the polishing head connector in a selected position with reference to the surface over which polishing is occurring such that the polishing head connector maintains an operating force within a desired range, the force being that generated between any polishing head on the polishing head connector and a vehicle wheel rim, the position control system actuating to drive the polishing head connector in a direction having at least a component parallel to the axis of rotation to maintain the operating force at the polishing head connector within the desired range.

2. The vehicle wheel rim polisher of claim 1 wherein the automation system further includes a function for accepting a transition position between the radial inner position of the polishing head connector and the radial outer position for the polishing head connector at which position the polishing head connector is reoriented during polishing.

3. The vehicle wheel rim polisher of claim 1 further comprising a faceplate to clamp a rim against the mounting end.

4. The vehicle wheel rim polisher of claim 1 wherein the axis of rotation is closer to horizontal that to vertical.

5. The vehicle wheel rim polisher of claim 1 wherein the position control system including a force compliant system.

6. The vehicle wheel rim polisher of claim 1 wherein the function for accepting a radial inner position of the polishing head connector accepts input by storing a position of the polishing head connector once it has been positioned at the radial inner position.

7. The vehicle wheel rim polisher of claim 1 wherein the function for accepting a radial outer position of the polishing head connector accepts input by storing a position of the polishing head connector once it has been positioned at the radial outer position.

8. The vehicle wheel rim polisher of claim 1 further comprising a safety shut down function operable if the operating pressure at polishing head connector moves out of the desired range.

9. The vehicle wheel rim polisher of claim 1 further comprising a stop block positionable to prevent radial outward movement of the polishing head connector.

10. The vehicle wheel rim polisher of claim 1 further comprising a support frame for supporting the spindle and a housing about the spindle and the polishing head connector.

11. The vehicle wheel rim polisher of claim 1 further comprising a wheel lift assembly for accepting wheel rim in a vertical position and moving the wheel rim to a position adjacent the spindle.

12. A method for polishing a wheel rim including a central wheel disc, annular tire retaining flanges extending therefrom and a tire mounted between the tire retaining flanges, the method comprising: providing a vehicle wheel rim polisher including a spindle with a mounting end, the spindle being drivable to rotate the mounting end about an axis of rotation, a polishing head support and movement mechanism including a polishing head connector and being moveable to move the polishing head connector at least substantially radially relative to, and substantially parallel with, the axis of rotation and an automation system including a function for accepting a radial inner position of the head connector, a function for accepting a radial outer position for the head connector and position control system to maintain the polishing head connector in a selected position with reference to the surface over which polishing is occurring such that the polishing head connector maintains an operating force within a desired range, the operating force being that generated between any polishing head on the polishing head connector and a vehicle wheel rim, the position control system actuating to drive the polishing head connector in a direction having at least a component parallel to the axis of rotation to maintain the operating force at the polishing head connector within the desired range; mounting the wheel rim on the mounting end to rotate about the axis; mounting a polishing head on polishing head connector; setting the radial outer position to a position adjacent an annular tire retaining flange of the rim and setting the radial inner position to a position radially inwardly of the annular tire retaining flange on the central wheel disc; and operating the polisher to rotate the rim about the axis of rotation and to drive the polishing head against the wheel rim with the operating force within the desired range while the polishing head cycles radially between the radial outer position and the radial inner position.

13. The method of claim 12 further comprising setting a transition position between the radial inner position and the radial outer position at which the polishing head connector is reoriented to accommodate a curvature change on the rim during a polishing operation.

14. The method of claim 12 wherein the step of setting at least one of the radial inner position and the radial outer position includes moving the polishing head connector to the desired position and storing this position in a memory component of the automation system.

15. The method of claim 12 further comprising selecting a plane of rotation for the polishing head at at least one of the radial inner position and the radial outer position.

16. The method of claim 12 further comprising entering into the automation system a polishing head diameter to be used in the method.

17. The method of claim 12 wherein the polishing head is driven against the rim while cycling radially over the rim without reference to a stored surface contour for the rim.

18. The method of claim 12 further comprising positioning a stop block adjacent the annular tire retaining flange of the wheel rim along a path where the polishing head cycles radially.

19. The method of claim 12 wherein the step of mounting the wheel rim includes rolling the wheel rim onto a wheel lift assembly and lifting the wheel into a position for mounting on the mounting end.

20. The method of claim 12 wherein a tire remains on the wheel rim during a polishing operation.

21. The method of claim 20 wherein the tire is deflated and a valve stem of the tire is pushed into the tire prior to commencing the polisher to drive the polishing head against the wheel rim.

* * * * *